United States Patent [19]

Zodrow et al.

[11] 4,385,960

[45] May 31, 1983

[54] GLUING APPARATUS FOR A LABELING MACHINE

[75] Inventors: Rudolf Zodrow, Düsseldorf; Heinz J. Rosenberg, Neuss; Rainer Buchholz, Düsseldorf, all of Fed. Rep. of Germany

[73] Assignee: Jagenberg-Werke AG, Düsseldorf, Fed. Rep. of Germany

[21] Appl. No.: 363,696

[22] Filed: Mar. 30, 1982

[30] Foreign Application Priority Data

Apr. 7, 1981 [DE] Fed. Rep. of Germany ..... 3113980

[51] Int. Cl.[3] ..... B65C 9/10; B65C 9/16

[52] U.S. Cl. ..... 156/568; 118/203; 118/261; 118/677; 156/357; 156/578

[58] Field of Search ..... 156/357, 578, 567, 568; 118/203, 204, 677, 261

[56] References Cited

U.S. PATENT DOCUMENTS

| | | | |
|---|---|---|---|
| 2,161,187 | 6/1939 | Mueller | 118/204 |
| 3,104,182 | 9/1965 | Schneider | 118/204 |
| 3,294,060 | 12/1966 | McIntyre | 118/261 |
| 4,279,687 | 7/1981 | Buchholz | 156/568 |

*Primary Examiner*—David A. Simmons

*Attorney, Agent, or Firm*—Sprung, Horn, Kramer & Woods

[57] ABSTRACT

The invention relates to a gluing apparatus for a labeling machine, consisting of a glue roller, a doctor blade adjustable with respect to the glue roller periphery and determining the thickness of the coat of glue to be applied, a glue feeder preceding the doctor blade in the direction of rotation of the glue roller, and a glue stripper which can be applied to the circumference of the glue roller. In accordance with the invention the glue stripper is disposed between the glue feeder and the doctor blade, and a hollow for the formation of a column of glue is disposed adjacent the cutting edge of the glue stripper.

1 Claim, 2 Drawing Figures

GLUING APPARATUS FOR A LABELING MACHINE

BACKGROUND

Figure 1:
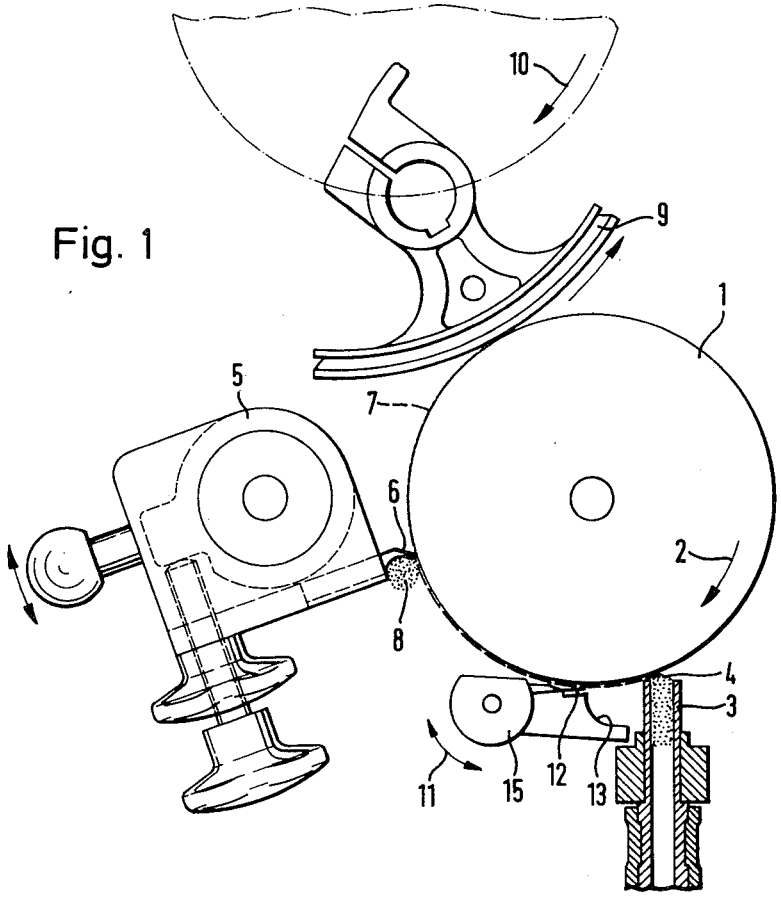

The invention relates to a gluing apparatus for a labeling machine, consisting of a glue roller, a doctor blade determining the thickness of the glue to be applied, a glue feeder preceding the doctor blade in the direction of rotation of the glue roller, and a glue stripper which can be applied to the circumference of the glue roller.

A frequent source of trouble in labeling stations is the fact that, when the delivery of the bottles is interrupted or discontinuous, the glue pallets continue to take labels from the label magazine even though they cannot be applied for lack of bottles. These unneeded labels pile up somewhere in the labeling station and thus interfere with the application of the following labels after the continuous delivery of bottles has been resumed. To overcome these difficulties, it is known to halt the dispensing of labels from the label magazine if bottle delivery stops. This does eliminate the main source of trouble in the application of labels, but another source of trouble is to be found in the fact that, if the delivery of bottles is interrupted or discontinuous, glue continues to be fed to the glue roll and hence also to the glue pallet. Since no glue is taken from the glue pallets when the label dispensing is halted, the excess glue causes glue to be thrown by the glue pallets, contaminating the labeling station.

To remedy these difficulties, it is known (DE-AS No. 15 86 370, DE-OS No. 26 32 332) to reduce the thickness of the glue coating by a tighter application of the glue wiper so that the glue roller continues to be wetted with glue, but only in such thickness that the glue cannot be flung from the glue roller.

According to the applicant's findings, however, reducing the thickness in which the glue is applied to the glue roller does not in every case suffice to prevent glue from being thrown. For if the pickup element keeps rolling against the glue roller and more glue is constantly added to it, this repeated application of glue will cause glue to collect at the back edge of the pickup surfaces of the pickup elements, and it will be thrown from this point and contaminate the machine.

Another disadvantage of the known machine is that, on account of the need to shift the doctor blade from the disengaged position to the engaged position and back, no matter how precisely it is adjusted in the beginning, in the course of time free play will set in so that the thickness of the glue coating will no longer be precisely controlled in the two positions. On account of this lack of control, the danger exists that in the engaged position too much glue will be applied and in the disengaged position too little glue will be applied, and the glue stripper will engage the glue roller with too much pressure, so that the glue roller with its delicate jacket will overheat.

Any change in the gap between the doctor blade and the glue roller to vary the thickness of the glue coating requires a corresponding change in the adjustment of the throw between the engaged and disengaged position of the doctor blade, and this requires considerable complexity of construction.

There is still another advantage in the known gluing apparatus. When the body and shoulder label and the top foil are to have different thicknesses of glue applied to them, correspondingly different thickness of glue must be transferred to the glue segments. The doctor blade is shaped and adjusted in relation to the glue roller accordingly. When the doctor blade is shifted from the engaged to the disengaged position, it is possible to reduce each of the different glue thicknesses to minimum values. The maximum throw, in other words, is limited by the glue coating having the least thickness. That is to say, it is possible to minimize only one of the coating thicknesses.

In another known gluing apparatus (DE-OS No. 20 59 234) two doctor blades are provided in tandem on the circumference of the glue roller and can be adjusted radially with respect to the glue roller. The glue is fed at the first doctor blade, while its thickness is adjusted with the second. The first doctor blade also serves for the purpose of holding back foreign bodies on the glue roller.

In another known gluing apparatus for a labeling machine (U.S. Pat. No. 4,279,687) it is made possible in the case of an interrupted bottle delivery to completely strip the glue from the glue roller and the glue segments when no labeling is being performed for the lack of bottles. For this purpose a glue stripper is provided ahead of the glue feeder and the doctor blade, in the direction of rotation of the glue roller, and can be pivoted simultaneously with the glue feeder such that, when the glue stripper engages the glue roller, the glue feeder is backed away from the glue roller, and when the glue stripper is backed away from the glue roller the glue feeder engages the glue roller. This known gluing apparatus has the advantage that, in the event of long interruptions, no glue can dry on the glue roller or on the glue segments. If despite the lack of bottles glue is constantly transferred to the glue segments even in a thin coat as in the case of the apparatus known from DE-OS No. 26 32 332, the ability of the glue segments to pick up glue is impaired when the labeling is resumed, with the result that excessively thin or nonuniform glue layers are applied to the labels. Otherwise the known gluing apparatus of U.S. Pat. No. 4,279,687 does not have the above-mentioned disadvantages of other known gluing apparatus.

THE INVENTION

The present invention is aimed at an improvement of the known gluing apparatus for labeling machines in accordance with U.S. Pat. No. 4,279,687.

In a labeling station whose operation has been stopped for lack of a bottle, the problem to which the invention is addressed is to re-apply a glue coating of uniform thickness to the surface of the stripped glue roller within the shortest possible time. In the case of the gluing apparatus known from U.S. Pat. No. 4,279,687, it takes longer than one revolution of the glue roller to produce the glue coating in uniform thickness. Under certain circumstances, this can be too long a time for high-output machines.

Like the known gluing apparatus of U.S. Pat. No. 4,279,687, the apparatus of the invention too has a glue stripper in addition to the doctor blade. The glue stripper, however, is disposed in accordance with the invention between the glue feeder and the doctor blade, such that, in the direction of rotation of the glue roller, first the glue feeder is encountered, then the glue stripper, and lastly the doctor blade. It is especially advantageous for these three devices to be disposed at the shortest possible distance apart.

For the gluing apparatus of the invention to be effective, it is essential that a hollow in which a glue column can accumulate be situated close to the cutting edge of the glue stripper. This glue column remains constantly present while the glue roller is rotating after being stripped of glue. When the glue stripper is rocked back to its disengaged position, the glue column provides for the wetting of the glue roller with a sufficiently thick coat of glue. The thickness of this coat is then reduced by the doctor blade to the desired level instantaneously over the entire length of the glue roller. The establishment of the desired thickness of glue on the glue roller is thus accomplished in less time than the glue roller needs for one revolution.

In addition to this advantage so important to high output machines, the gluing apparatus of the invention has additional advantages for labeling machines:

- the gluing apparatus of the invention is effective in a vertical arrangement of glue segments for body and shoulder labels and cap foils, regardless of any differences in the thickness of glue they apply,
- in the disengaged state no glue is thrown,
- the adjustment of the doctor blade is not affected or impaired by the shift between the engaged and disengaged position,
- even in the case of relatively long interruptions, glue does not dry on the glue roller nor on the glue segments,
- the gluing apparatus of the invention is simple in construction and easy to clean,
- the drive for engaging and disengaging the glue stripper can be produced more easily than the one provided in the case of the gluing apparatus of U.S. Patent 4,279,687 for the common movement of the glue feeder and of the glue stripper,
- the wettability of the glue roller is good regardless of the quality of the glue.

The invention will be further described with reference to the drawings, wherein

Figure 2:
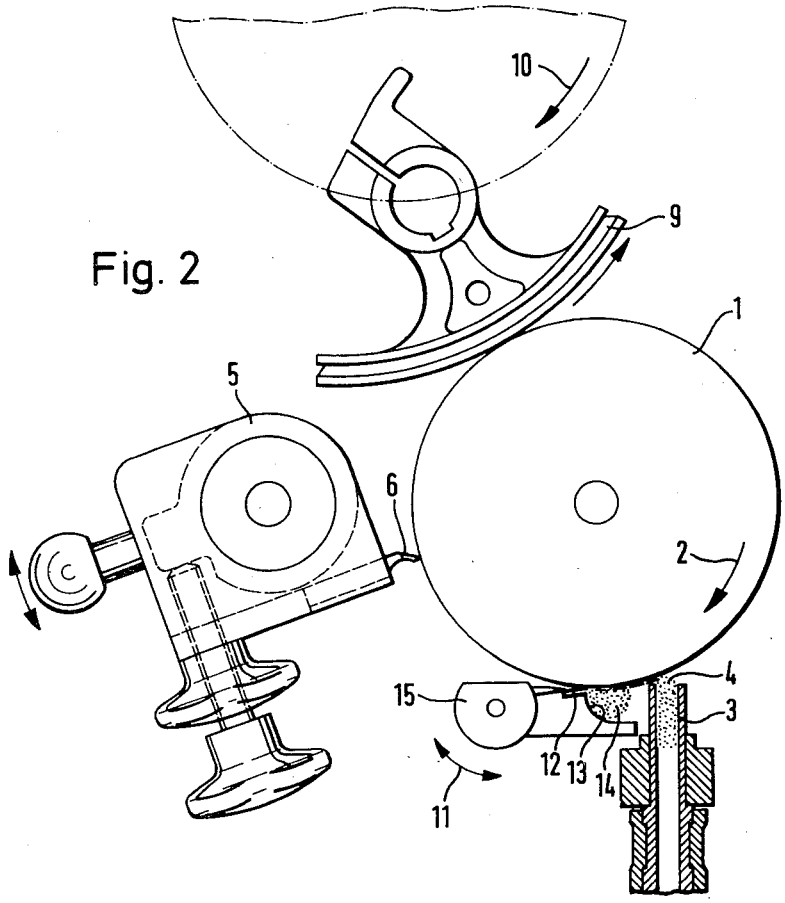

FIG. 1 is a schematic top plan view of a gluing apparatus in accordance with the invention in the engaged position, and FIG. 2 is a similar view of the apparatus in the disengaged position.

The glue roller 1 is made to rotate in the direction of the arrow 2. A tube serves as the feeder 3 for the glue 4. The glue is then transferred to the glue roller 1 at the upper end of the latter. The doctor blade 6, mounted on a support 5 and adjustable at varying distances from the surface of the glue roller, produces the glue coating 7 in a thickness that is uniform over the length of the glue roller 1. The excess glue which is not allowed past the doctor blade 6 forms itself into a column 8 which spirals downward by gravity in front of the doctor blade 6 and drips into a collector. The thickness of the glue coating 7 usually amounts to about 0.2 mm. The glue film 7 of this thickness is carried on the glue roller 1 to the glue segment 9, which accepts the glue from the glue roller 1 and, after further rotation in the direction of arrow 10, transfers it to a label or foil in a manner which is not represented in the drawing.

In accordance with the invention, a glue stripper 12 which can pivot in the direction of the arrow 11 is disposed in back of the glue feeder 3, between the latter and the doctor blade 6. A hollow 13 is formed adjacent the cutting edge of the glue stripper 12, in which a column of glue 14 forms, as seen in FIG. 2, when the glue stripper is pressed against the surface of the glue roller 1 and pares glue away from the surface of the glue roller 1, the glue flowing downward under gravity with a spiraling movement into a collector. Except for the section between the glue stripper 12 and the point of application of the glue by the glue feeder 3 the surface of the glue roller 1 remains unglued in the disengaged position represented in FIG. 2. The term, "disengaged position", as used herein, refers to the position in which no labeling is performed because no bottle is presented, and in which accordingly no glue must be transferred to the glue segment 9 by the glue roller 1.

Upon the shift from the disengaged position of FIG. 2 to the engaged position of FIG. 1, the glue stripper 12 is pivoted clockwise by the rotation of its support 15 until the cutting edge of the glue stripper 12 is situated at a distance of 2 to 3 mm away from the surface of the glue roller 1. A coat of glue of that thickness can then be carried on the surface of the glue roller 1 past the glue stripper 12. The excess material that is held back by the following doctor blade 6 immediately forms the column of glue 8, which provides the assurance that the glue coating flowing through the doctor blade 6 will be of uniform thickness.

The time elapsing between the pivoting of the glue stripper 12 away from the circumference of the glue roller 1 and the formation of a uniform glue film is determined by the distance of the cutting edge of the glue stripper 12 from the doctor blade 6 and by the circumferential speed of the glue roller 1. Due to the closely adjacent arrangement of the glue stripper 12 and doctor blade 6, this time can be kept very short. This assures high flexibility and performance of the gluing apparatus when it is shifted from the disengaged to the engaged position.

It will be understood that the specification and examples are illustrative but not limitative of the present invention and that other embodiments within the spirit and scope of the invention will suggest themselves to those skilled in the art.

We claim:

1. In a gluing apparatus for a labeling machine, comprising a glue roller, a doctor blade adjustable with respect to the glue roller periphery and determining the thickness of the layer of glue being applied, a glue feeder disposed ahead of the doctor blade in the direction of rotation of the glue roller, and a glue stripper which can be applied to the periphery of the glue roller, the improvement which comprises disposing the glue stripper between the glue feeder and the doctor blade, and providing a hollow throat-like supporting surface for a glue column adjacent the cutting edge of the glue stripper and means for moving the stripper from operative to inoperative position.

* * * * *